US008986498B2

(12) United States Patent
Fefin

(10) Patent No.: US 8,986,498 B2
(45) Date of Patent: Mar. 24, 2015

(54) LABEL EJECTION DEVICE

(75) Inventor: Christian Fefin, Malbuisson (FR)

(73) Assignee: SICPA Holding SA, Prilly (CH)

( * ) Notice: Subject to any disclaimer, the term of this patent is extended or adjusted under 35 U.S.C. 154(b) by 0 days.

(21) Appl. No.: 13/504,793

(22) PCT Filed: Oct. 28, 2010

(86) PCT No.: PCT/EP2010/066374
§ 371 (c)(1),
(2), (4) Date: Apr. 27, 2012

(87) PCT Pub. No.: WO2011/051396
PCT Pub. Date: May 5, 2011

(65) Prior Publication Data

US 2012/0211173 A1 Aug. 23, 2012

Related U.S. Application Data

(60) Provisional application No. 61/255,698, filed on Oct. 28, 2009.

(51) Int. Cl.
*B32B 38/10* (2006.01)
*B65C 9/18* (2006.01)
(Continued)

(52) U.S. Cl.
CPC ..... *B65C 9/1865* (2013.01); *B65C 2009/0093* (2013.01); *B65C 9/40* (2013.01); *B65C 2009/404* (2013.01)
USPC ..... 156/715; 156/719; 156/767

(58) Field of Classification Search
CPC ..... B65C 2009/404; B65C 2009/0093; B65C 9/42; B65C 9/1865
USPC ..... 156/715, 719, 767, 933, 944
See application file for complete search history.

(56) References Cited

U.S. PATENT DOCUMENTS

2006/0144521 A1 7/2006 Esposito
2007/0114109 A1 5/2007 Berndtsson et al.
2007/0187501 A1 8/2007 Lenkl et al.

FOREIGN PATENT DOCUMENTS

EP 1 787 913 5/2007
GB 2425298 10/2006
(Continued)

OTHER PUBLICATIONS

Australian Office action conducted in counterpart Australian Appln. No. 2010311411 (Mar. 27, 2014).
(Continued)

*Primary Examiner* — Mark A Osele
(74) *Attorney, Agent, or Firm* — Greenblum & Bernstein, P.L.C.

(57) ABSTRACT

The invention relates to a label ejection device (101,201,301,401,501,601,1201,1301), a labeling printing system comprising said device and a method for discarding labels, in particular self-adhesive labels (103,203,303,403,603). The invention is concerned in particular with preventing faulty labels from being applied to items (or containers containing such items), with minimal attendant interruption of machine operation. The effective labeling systems and equipment are not perfect and, on occasion, "incorrect" or faulty labels (103,203,303,403,603) may be applied to containers. There is a need for an improved label ejection device (101,201,301,401,501,601,1201,1301) and an improved labeling printing system that more efficiently and effectively removes labels (103,203,303,403,503,603) from a sheet like support (104,204,304,404,504,604,1204). An object of the present invention is to improve the apparatuses, systems and methods for discarding and collecting labels, in particular self-adhesive labels (103, 203, 303, 403, 503, 603).

6 Claims, 8 Drawing Sheets

(51) Int. Cl.

| | |
|---|---|
| ***B65C 9/40*** | (2006.01) |
| *B65C 9/00* | (2006.01) |

(56) References Cited

FOREIGN PATENT DOCUMENTS

| | | |
|---|---|---|
| JP | 2001 055212 | 2/2001 |
| JP | 2003-051517 | 2/2003 |
| JP | 2005-255257 | 9/2005 |
| JP | 2008-114904 | 5/2008 |
| WO | 2005/102845 | 11/2005 |
| WO | 2008/012633 | 1/2008 |
| WO | 2008/055052 | 5/2008 |

OTHER PUBLICATIONS

Search report from IPRP / PCT/EP2010/066374, mail date is May 1, 2012.

Search report from PCT/EP2010/066374, mail date is Feb. 7, 2011.

Japan Office action conducted in counterpart Japan Appln. No. P2012-535830 (Sep. 2, 2014) (w/ English language translation).

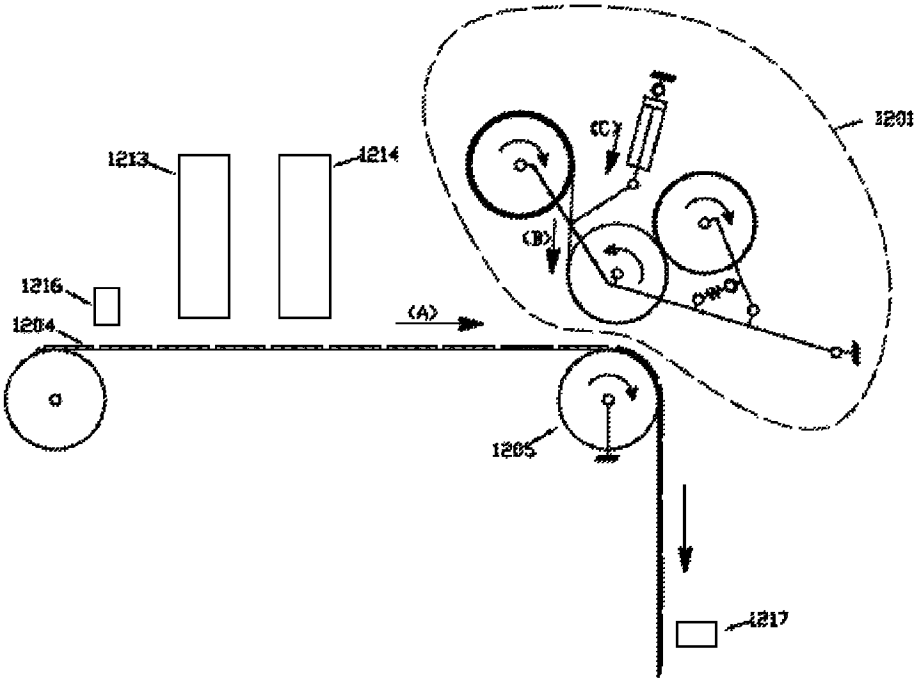
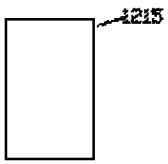
Figure 12. Labelling printing Reel to Rell system

Figure 13. Labelling Printing Sheet to Sheet system
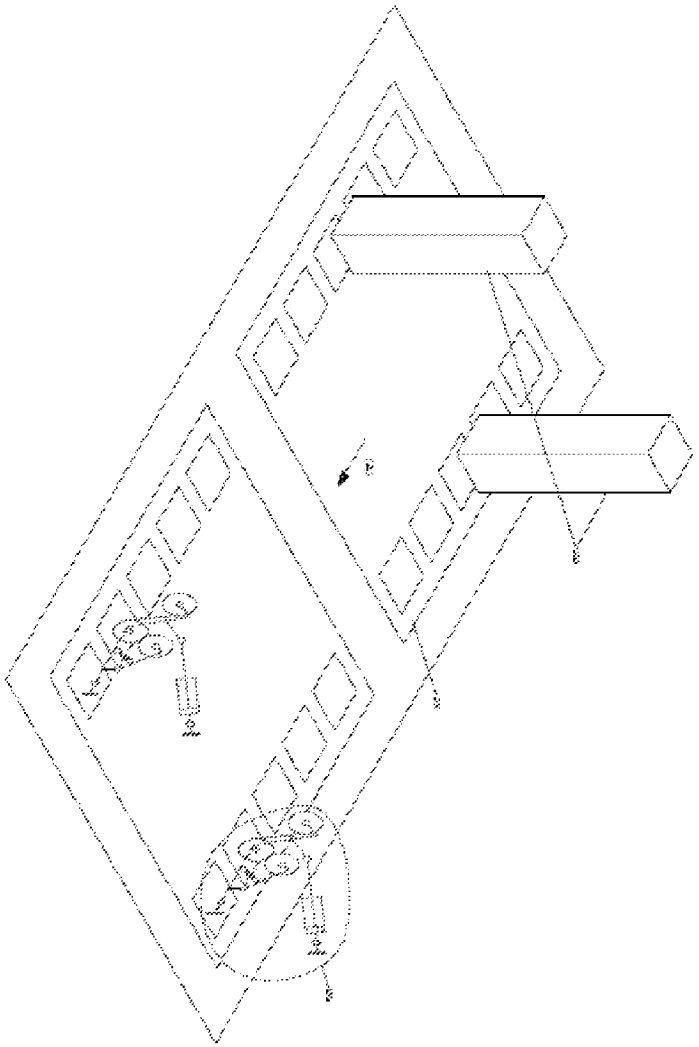

LABEL EJECTION DEVICE

BACKGROUND

The invention relates to a label ejection device, a labeling printing system comprising said device and a method for discarding labels, in particular self-adhesive labels. The invention is concerned in particular with preventing faulty labels from being applied to items (or containers containing such items), with minimal attendant interruption of machine operation.

Packagers of foods, pharmaceuticals and as well as the tax stamp industry, demand high level of accuracy and reliability in the labeling process.

There are number of labeling systems adapted to apply pressure-sensitive labels to articles or containers at a label applying station. Labels are carried initially by a supporting tape with the adhesive side of the label facing toward the supporting tape.

The labels precisely contain information relating to the products contained in said containers, giving basic information about the product, such as for example the commercial name and/or a distinguishing image, the number of the production batch, the capacity of the product, the chemical composition, the dates of packaging and expiration, or similar.

The effective labeling systems and equipment are not perfect and, on occasion, "incorrect" or faulty labels may be applied to containers. Incorrect/faulty labels are wrong labels or labels with poor or illegible lot numbers, or with secure features badly printed. This is a matter of particular concern to packagers. An incorrectly labeled container could lead to a costly product recall, and might result in serious injury. Accordingly, equipment and systems have been developed for detecting the presence of incorrect/faulty labels using several types of sensors, trigger, captors and cameras well known from those skilled in the art. Labeling machines that provide labeling error detection prior to the application of the labels onto the containers are preferred to those which provide error detection following application.

In particular, a faulty label ejection device may be associated to a labeling printing system to provide packagers with rolls of security printed labels with only self-adhesive labels correctly printed. Thus, it is necessary to prevent a faulty label from being applied on a container.

WO 2008/055052 discloses an incorrect label removal system for removing unwanted labels from a web of labels in a labeling machine. The incorrect label removal system includes a label peel assembly positioned between two fixed points along the direction of travel of the web of labels. The label peel assembly provides a first orientation in which labels remain on the web as the web passes the label assembly, and selectively provides a second orientation in which labels are removed from the web. The label peel assembly provides that a length of the web between the two fixed points is substantially the same when the label peel assembly is in each of the first orientation and the second orientation.

GB 2 425 298 discloses a peel plate for labeling retractable when label defective. Said peel plate assembly functions in a normal position of the plate being extended for the purposes of peeling adhesive labels from a supply web and directing them toward containers, but can be retracted selectively when a label is identified as incorrect or faulty, thereby leaving faulty or incorrect labels on the label supply web at least until they are removed from the active site of label application. When the peel plate and its supporting Nock are retracted from the normal position shown, the web passes around a roller which has no sharp edge to cause peeling. Defective labels are detected by a scanner connected to a central processing unit.

WO 2008/012633 discloses an apparatus and method for rejecting irregular or faulty labels. An apparatus has a removing unit for removing an altered or faulty self-sticking label applied on a supporting tape of labels moving along an advancing direction. The collecting unit includes another supporting tape for supporting the self-sticking label. A supporting unit is arranged for supporting the removing unit and the collecting unit. The removing unit comprises removing means for removing said altered or faulty labels from said supporting tape and collecting means arranged for receiving said altered labels from said removing means; said collecting means comprises a further supporting tape suitable for supporting and collecting said altered labels.

The removing means comprises separating means arranged for cooperating with sucking element for separating the faulty labels from the primer supporting tape, said separating means being opposed to the sucking means.

A collecting unit is arranged for receiving the self-sticking label from the removing unit. The collecting unit includes another supporting tape for supporting the self-sticking label. A supporting unit is arranged for supporting the removing unit and the collecting unit. A moving unit is supported by the supporting unit, and arranged for moving the latter supporting tape along an advancing direction with a desired operating speed.

The apparatus prevents the altered or faulty self-sticking label from being applied to cylindrical containers. The apparatus allows the altered or faulty self-sticking label to be more easily identified for discarding the self-sticking label.

Apparatus for discarding labels is arranged for removing from the supporting tape non-satisfying labels, for example because provided with faded or unreadable printing, before being applied on a respective container.

Said apparatus comprises a peel plate, bedplate or separating means supporting an operating group and a collecting group. Said operating group comprises an operating roller cooperating with removing means arranged for removing the faulty labels from the supporting tape and transferring said faulty labels on the collecting group. Said collecting group comprises two rollers which of them is free to rotate for collecting faulty labels.

When the discarding apparatus detects, by means of a sensor, the presence of a faulty label, a control unit actuates the operating group, which removes such label from the supporting tape. The faulty label, gradually detached from the supporting tape, is stuck on the collecting roller. Thus, said collecting roller accumulates a plurality of faulty labels increasing consequently its own diameter up to a limit value established by an operator. Once such limit value has been reached, the operator removes and substitutes the collecting roller.

We met some issues in the apparatus of the prior art. The apparatuses disclosed for discarding and recovering labels associated with labeling machines comprise a peel plate or separating means. At the detection of a faulty label by standard detection means such as captor or camera, the position of the faulty label is calculated on the supporting tape for removing said faulty label detected, depending on the label's length, the space between two labels, and the number of labels in front of the faulty label. The peel plate or separating means is performed on an active position to remove the said faulty label from the supporting tape. A friction occurs on the supporting tape providing with a tension which could lead sometimes to a rupture of the said primer supporting tape. A deformation and damage of the supporting tape occurs after each removal of faulty label leading to a position's imprecision of the labels more and more important. An adjustment of the detection means is necessary to redefine the exact positions of the next labels printed.

There is an interruption of the applying label station and sometimes if a rupture of the supporting label happens, a complete change of the roll of labels already printed is necessary.

In addition, during the separation of the faulty label from the primer supporting tape, there are some vibrations of the supporting tape itself leading also to adjustment issue. The tension of the supporting tape between the supporting rollers is less tightened.

All cases lead to a remarkable waste of time and money so as to obtain a new correct positioning of labels. The move of the primer supporting tape along the advancing direction at a high speed is not possible due to all adjustments necessary.

Said previously cited issues of the label ejection device disclosed in the state of the art lead to additional issues when the said device is associated to a labeling printing system comprising a printing device, such as for example an inkjet printer, being able to print out on the blank labels. Indeed, a gap in the positioning of the labels leads to a print out badly performed on the next blank label. A succession of ejection of label badly printed is happened in the absence of a manual adjustment of the sheet like support before the printing device and the detection means. The print out of secure labels on a supporting tape with complex security features requires a high quality of print with an important precision in the positioning. Said print out may need several types of ink, some various printer such as inkjet printer and potentially some additional device such as UV dryer so as to limit set off after potential winding of the labels in a collecting roller for delivery to a packagers. The previously constraints cited and a processing of the printing labeling system at a high speed are not possible with the existing apparatuses for discarding faulty labels.

An object of the present invention is to improve the apparatuses, systems and methods for discarding and collecting labels, in particular self-adhesive labels.

There is a need, therefore, for an improved label ejection device and an improved labeling printing system that more efficiently and effectively removes labels from a sheet like support.

SUMMARY OF THE INVENTION

In a first aspect, this invention provides a novel label ejection device which comprises removing means for discarding labels applied on a sheet like support, wherein said removing means has an adhesive portion operable to enter into contact with a part of the surface of a label on the sheet like support, and adhere to said part; and said label ejection device is operable to move apart said adhesive portion from the sheet like support up to the separation of the label, thereby discarding said label from said sheet like support.

When removing a label with the label ejection device of the invention, no vibration or slight jolt of the sheet like support happens. Any device (such as camera, printer, . . . ) on the production line needing a perfect positioning of labels, no interruption of the sheet like support, no vibration may then be used for the sorting or removing of a label. Even small labels can be removed without difficulties by contrast with the prior art. Thus, a multitude of sizes of labels may be carried on the sheet like support before being applied on the respective container.

In an embodiment of the first aspect of the invention, the label ejection device has said sheet like support being operable to move along an advancing direction (A), said part of the surface of the label corresponds to a border of the label along said direction (A).

Said preferred embodiment allows removing a label moving along an advancing direction. A removal of label by adhesion allows a removing of any label of any size from the sheet like support in a smooth manner at any speed, preferably at high speed. The detachment of the label from the sheet like support is easier when the removing means adhere to the border of the label. Preferably the best border of the label to adhere is the advancing front border.

In addition to the first aspect of the invention, the label ejection device further comprises collecting means operable to receive said removed label.

A sorting or a collecting of label is possible due to collecting means added to the present invention. Any sorting of size, color and so one may be performed before a specific application on the respective container. An example of sorting such as an ejection of label not compliant is also possible. The adhesive portion of the removing means gets free due to the presence of the collecting means in the label ejection device.

In another embodiment of the invention of the first aspect, the label ejection device comprises collecting means having an adhesive portion; and said removing means being operable to transfer the removed label to the collecting means by making a portion of said removed label to adhere to said adhesive portion of the collecting means.

A sorting or collecting of label may be performed with removing means and several collecting means to sort labels depending on any criteria (size, color, . . . ). Several uses of removing means may be performed due to the transfer of the last removed label to any collecting means. The adhesive part of the removing means may be reused.

In another embodiment of the invention of the first aspect, the label ejection device has collecting means comprising a driver operable to move a collecting tape supporting said adhesive portion.

A new virgin adhesive portion of the collecting tape is placed to transfer the removed label from the removing means to the collecting means leading to a best adhesion at any removing and collecting of labels.

In another embodiment of the first aspect of the present invention, the label ejection device is disclosed, wherein said removing means comprises a portion of said collecting tape operable to enter into contact with said part of the surface of a label on the sheet like support, and adhere to said part.

Said embodiment leads to a simplification of the label ejection device and limits the transfer by adhesion. The quality of the removed label stays the best, keeping the printing on the label. The removing of the label is faster. There is less damage on the removed label. The apparatus is easier to build and more simple.

In another embodiment of the first aspect of the present invention, the label ejection device comprises said collecting tape which is wound around a driving roller.

A new virgin adhesive portion of the collecting tape is placed at each removing in front of the label detected. Consecutive labels to remove and best quality of adhesion of the portion of the collecting tape may be possible.

In another embodiment of the first aspect of the present invention, the label ejection device is disclosed, wherein said sheet like support is a supporting tape being operable to move along an advancing direction (A) and being bent on a supporting roller, said label adhering to the supporting tape, and wherein said collecting tape is operable to move between two driving rollers; and said removing means includes a pressing roller operable to bend the collecting tape at a level of the supporting roller, and driving means operable to push said pressing roller and make said portion of the collecting tape to adhere to said part of the surface of the label on the supporting tape.

With said embodiment, the adhesion is optimal with a pressing roller pushing on the non adhesive side of the collecting tape leading to a smooth and efficient collect of the removed label. The contact of the removing means on the sheet like support at the level of the supporting roller is more efficient. The change of way after the supporting roller of the sheet like support leads to a best easiness to remove a label.

In a further embodiment of the first aspect of the present invention, the label ejection device further comprises detection means operable to detect a faulty label on the sheet like support, and transmit a signal indicating a detected faulty label; a control unit operable to, upon reception of the signal from said detection means, control the label ejection device to discard said faulty label from the sheet like support.

Any faulty label, such as badly printed, damaged, and so on . . . may be ejected from the supporting tape. A complete roll of printed label may be delivered or all printed label may be provided to the applying station of a labeling applicator. No faulty label will be applied on a container.

In a second aspect of the invention, a method for discarding labels applied on a sheet like support is disclosed, characterized by the steps of making an adhesive portion of removing means to adhere to a part of the surface of a label on the sheet like support; and moving apart said adhesive portion from the sheet like support up to the separation of the label, whereby said label is removed from said sheet like support.

Said method leads to a removing of a label using the label ejection device disclosed in the present invention. The advantage of this method is the easiness to remove a label.

In a third aspect of the invention, a labeling system for discarding faulty labels applied on a sheet like support, comprises a printer operable to print out a label on the sheet like support; a faulty label ejection device which comprises detection means operable to detect a faulty printed label on the sheet like support, and transmit a signal indicating a detected faulty printed label; removing means for discarding a faulty printed label applied on the sheet like support having an adhesive portion operable to enter into contact with a part of the surface of the faulty printed label on the sheet like support, and adhere to said part; said label ejection device being operable to move apart said adhesive portion from the sheet like support up to the separation of the faulty printed label, thereby discarding said faulty printed label from said sheet like support; and a control unit operable to, upon reception of the signal from said detection means, control the label ejection device to discard the detected faulty printed label from the sheet like support.

A printing on production line at high speed needs an important stability, no vibration of the sheet like support, a perfect positioning of the new label to print in order to limit the waste of labels. A removing of a label doesn't lead to a bad printing of the label with the present label ejection device. Thus, reliable removing of consecutive labels may be performed. The speed of the web of label on the production line is not interrupted or limited by the label ejector with the use of the present invention. The rate of faulty label ejected is lower with the said faulty label ejection disclosed in the present invention.

In a first embodiment of the third aspect of the invention, a labeling system is disclosed, wherein said sheet like support is a supporting tape being operable to move along an advancing direction (A) and being bent on a supporting roller, said faulty printed label adhering to the supporting tape, said labeling system which further comprises collecting means having an adhesive portion operable to receive said discarded faulty printed label, and comprising a driver operable to move a collecting tape supporting said adhesive portion, said collecting tape being operable to move between two driving rollers; and said removing means being operable to transfer the discarded faulty printed label to the collecting means by making a portion of said discarded faulty printed label to adhere to said adhesive portion of the collecting means, and comprising a portion of said collecting tape operable to enter into contact with said part of the surface of the faulty printed label on the sheet like support, and adhere to said part; said removing means including a pressing roller operable to bend the collecting tape at a level of the supporting roller, and driving means operable to push said pressing roller and make said portion of the collecting tape to adhere to said part of the surface of the faulty printed label on the supporting tape.

At the detection of a faulty label, all labels will be able to be removed by the faulty label ejection device. The removing means are a pressing roller pushing on the collecting tape containing the adhesive portion needed to catch the faulty label by adhesion. The risks to damage or to cut the collecting tape are reduced with the help of a pressing roller as removing means. The contact between the pressing roller and the supporting roller of the supporting tape are more uniform and smoother. That means that the advancing speed of the supporting tape may be faster without any slight jolt of the said supporting tape. No printing interruption of the labels on the production line will be occurred.

The faulty label ejection device is adapted to a labeling printing system because of the absence of slight jolt or vibration during the ejection of the faulty label. The ejection of a faulty label will not conduct to new badly printed labels. No perturbation of the supporting tape will be happened leading to good printing quality of the label at high speed. The use of this faulty label ejection device reduces the number of faulty label to remove.

DETAILED DESCRIPTION OF THE INVENTION

The above and other objects and advantages of the present invention will become more readily apparent upon consideration of the following

DETAILED DESCRIPTION

So as to explain more precisely the core of the invention, a definition of the term adhesion is needed. From those skilled in the art, adhesion is the tendency of certain dissimilar molecules to cling together due to attractive forces. Adhesive materials fill the voids or pores of the surfaces and hold surfaces together by interlocking. The adhesion is detached to the suction or aspiration principles.

In a first aspect, the present invention describes a label ejection device which comprises removing means for discarding labels applied on a sheet like support, wherein said removing means has an adhesive portion operable to enter into contact with a part of the surface of a label on the sheet like support, and adhere to said part; and said label ejection device is operable to move apart said adhesive portion from the sheet like support up to the separation of the label, thereby discarding said label from said sheet like support.

Said label ejection device for discarding labels applied on a sheet like support of labels which could have different sizes, spaced at equal or different distance. The sheet like support may be any kind of support constituted in any material such as a web of label simply placed in contact to a transporting way on a production line. The sheet like support may also contain an adhesive sticking the web of label on the sheet like support or be only a support whereby the labels are pre-cut or simply placed on it such as the wine label.

After adhesion of the surface of the label to remove by the removing means of the label ejection device, the movement between the label ejection device and the sheet like support leads to a complete separation of a label to its sheet like support.

The said sheet like support may move along a direction or may be in a fixed position. The label ejection device may move along the sheet like support to remove a label or may be fixed. Both, the sheet like support and the removing means of the label ejection device may move. Another embodiment of the present invention may be a move of the sheet like support by group of labels and the label ejection device moves also in the same or in an opposite direction to remove label group by group on the sheet like support.

The label ejection disclosed in the present invention comprises a sheet like support being operable to move along an advancing direction (A), and the part of the surface of the label adhering to the removing means corresponds to a border of the label along said direction (A). Any border of the label is a good point of contact for the removing means so as to adhere on it. However, the preferred border of the label adhering to the removing means is the advancing front border. The adhesive part of the removing means enters into contact to the border of the label whatever the placement of the label on the sheet like support leading to a good separation of the part of the surface of the label adhering to the removing means from the sheet like support. The separation of the label adhering to the removing means from the sheet like support is due to the movement between the sheet like support and the removing means of the label ejection device, and the advancing speed of the sheet like support carrying the web of label or the advancing speed of the label ejection device moving along the sheet like support.

Several configurations may be possible. After adhesion of the removing means, the label ejection or the sheet like support may move from each other in several directions for example in the best modes in a perpendicular or in diagonal way. This first movement leads to a complete separation of the label if this latter has a small size or simply a first detachment of the part of the surface of the label adhering to the removing means from the sheet like support if this latter has a middle or big size. A second movement, if needed, to obtain a complete separation is due to the advancing speed between the label ejection device and the sheet like support. The sheet like support or the label ejection device may move on themselves in any direction or in opposite direction. Thus, the label leaves the sheet like support in a smooth and regular manner at the cumulate speed of both or the speed of one or of the other.

The removal of the label will not be performed in the same way depending on its size so as to have the smoother removal process as possible. For a small size of label, the removal will be a simple stamping with the removing means of the label ejection device on the sheet like support carrying the label to remove. At the opposite, for a big size of the label, said label will be caught at one of its border of the label, preferably the advancing front border, by adhesion of the removing means of the label ejection device, and will be gradually separated from the sheet like support up to a complete separation. The advancing speed of the label applied on the sheet like support or the advancing speed of the label ejection device compared to the sheet like support defines the speed of the progressive separation of the label caught by the removing means from the sheet like support. A constant advancing speed of both options previously cited avoiding any bumps will lead to have no slight jolt or vibration of the sheet like support.

Once a label adhering to the removing means of the label ejection device, a system adding an adhesive layer to the removing means will give the possibility to adhere new labels.

In another embodiment, the label ejection device further comprises collecting means operable to receive the removed label. A collecting means is used to collect or to sort labels. A sorting of the labels may be useful before applying by a label applicator said label to specific and respective containers.

In addition, the label ejection device disclosed in the present invention comprises collecting means with an adhesive portion and removing means being operable to transfer the removed label to the collecting means by making a portion of said removed label to adhere to said adhesive portion of the collecting means.

The adhesive part of the surface of the removing means enters into contact to the label applied on the sheet like support, a transfer will occur from the removing means to the collecting means to get free the removing means for next removing of label by the label ejection device.

Said collecting means comprises a driver operable to move a collecting tape supporting said adhesive portion. The collecting means may be a collecting roller of different diameter. Several virgin adhesive places on the collecting roller lead to a best adhesion in the transfer of removed labels. The number of label able to adhere to the collecting means increases. A system applying another layer of adhesive on the collecting means will provide a best quality of adhesion of label to collect.

The removing means of the label ejection device comprises an adhesive portion of the collecting tape operable to enter into contact with the part of the surface of a label on the sheet like support, and adhere to said part. This embodiment leads to limit the transfer of label from removing means to collecting means.

The collecting tape of the collecting means is wound around a driving roller. Several driving rollers may be added to the collecting means. Several collecting tapes may be added at the label ejection device to sort labels before applying them to respective containers. Several forms of collecting means comprising collecting tape are possible as shown in FIG. 2*a* or 2*b*.

In a preferred embodiment of the invention, the label ejection device comprises a sheet like support such as a supporting tape which is operable to move along an advancing direction (A) and is bent on a supporting roller. The labels are self-adhesive to the supporting tape. The label ejection comprises also the collecting tape of the collecting means being operable to move between two driving rollers and the removing means which includes a pressing roller operable to bend the collecting tape at a level of the supporting roller, and driving means operable to push said pressing roller and make said portion of the collecting tape to adhere to said part of the surface of the label on the supporting tape. A pressing roller is the best embodiment of the removing means pushing the collecting tape. Other embodiments are possible such as sticking pad, a bedplate, a peel plate, separating means or similar.

Another embodiment of the present invention is a collecting tape turning between two driving rollers such as a label conveyor belt. The removing means such as a pressing roller may push on the non adhesive side of the collecting tape. The removed label adheres to the collecting tape and this latter may be applied on the respective container by a label applicator system. In addition, a system adding an adhesive layer to the collecting tape may be included to the label ejection device. However, in case of a faulty label ejection, the number of label removed is limited and a collecting tape able to receive about ten fault labels is enough.

Detection means, such as optical captor, captor with optical fiber, sensor or camera, or similar, operable to detect a faulty printed label applied on the sheet like support and operable to transmit a signal indicating a detected faulty printed label are used for sending a signal to the control unit of the device at the detection of a faulty label. Upon reception of the signal from said detection means, the control unit is operable to discard the detected faulty label from the sheet like support. Detection means are positioned at several positions on the labeling production line, such as before the label ejection device above the printed side of the labels carried by the sheet like support. Some other captor may be added near the collecting means to confirm the right transfer to the collecting means of the faulty labels. Another sensor may be positioned after the faulty label ejection device so as to confirm the right withdrawal of the faulty label from the primer supporting tape. The control unit is operable to supervise the sorting or the collecting of the web of labels carried by the sheet like support. Several driving rollers may be added to the sheet like support to give more time to the label ejection device to remove potential faulty label because of the variation of the speed of the sheet like support, size of the label, drying time of the printing, adding of several device or inkjet printer, etc. . . . .

The label ejection device further comprises detection means operable to detect a faulty label on the sheet like support, and transmit a signal indicating a detected faulty label; a control unit operable to, upon reception of the signal from said detection means, control the label ejection device to discard said faulty label from the sheet like support.

A method for discarding labels applied on a sheet like support, characterized by the steps of making an adhesive portion of removing means to adhere to a part of the surface of a label on the sheet like support and moving apart said adhesive portion from the sheet like support up to the separation of the label, whereby said label is removed from said sheet like support.

Another method for discarding labels applied on a sheet like support comprises also an additional step of collecting removed labels having an adhesive portion.

Another method for discarding labels applied on a sheet like support further comprises the step of transferring the removed label from the removing means to the collecting means of the label ejection device.

Another method for discarding labels applied on a sheet like support further comprises the step of driving the collecting means so as to move collecting tape to collect removed labels. Several drivers may be added to the collecting tape to let a virgin adhesive portion for removing the next label.

A method for discarding labels applied on a sheet like support, characterized by the steps of making an adhesive portion of the collecting tape, which is a portion of the removing means, operable to enter into contact with the part of the surface of a label on the sheet like support; and adhering to said part; and moving apart said adhesive portion from the sheet like support up to the separation of the label, whereby said label is removed from said sheet like support; and driving the collecting means so as to move the collecting tape to collect removed labels.

Another method for discarding labels applied on a sheet like support further comprises also the step of winding around the collecting tape.

A labeling system for discarding faulty labels applied on a sheet like support, comprises a printer operable to print out a label on the sheet like support; a faulty label ejection device which comprises detection means operable to detect a faulty printed label on the sheet like support, and transmit a signal indicating a detected faulty printed label; removing means for discarding a faulty printed label applied on the sheet like support having an adhesive portion operable to enter into contact with a part of the surface of the faulty printed label on the sheet like support, and adhere to said part; said label ejection device being operable to move apart said adhesive portion from the sheet like support up to the separation of the faulty printed label, thereby discarding said faulty printed label from said sheet like support; and a control unit operable to, upon reception of the signal from said detection means, control the label ejection device to discard the detected faulty printed label from the sheet like support.

Said labeling system may comprise on the production line several inkjet printers, some detection means validating the removing of a faulty label at each control point in the production line, a control unit being able to supervise the correct working of the line and of the label ejection device.

The labeling system further comprises a sheet like support such as a supporting tape being operable to move along an advancing direction (A) and being bent on a supporting roller, said faulty printed label adhering to the supporting tape, said labeling system further comprising collecting means having an adhesive portion operable to receive said discarded faulty printed label, and comprising a driver operable to move a collecting tape supporting said adhesive portion, said collecting tape being operable to move between two driving rollers; and said removing means being operable to transfer the discarded faulty printed label to the collecting means by making a portion of said discarded faulty printed label to adhere to said adhesive portion of the collecting means, and comprising a portion of said collecting tape operable to enter into contact with said part of the surface of the faulty printed label on the sheet like support, and adhere to said part; said removing means including a pressing roller operable to bend the collecting tape at a level of the supporting roller, and driving means operable to push said pressing roller and make said portion of the collecting tape to adhere to said part of the surface of the faulty printed label on the supporting tape. Use of the faulty label ejection device for discarding faulty labels according to all the embodiment of the label ejection device disclosed previously in the present invention.

The invention can be better understood and carried out with reference to the enclosed drawings that illustrate a preferred, exemplifying and non-restrictive embodiment thereof, wherein:

FIG. 1*a* is a view of the main principle to remove a label by adhesion from a sheet like support of labels with a label ejection device.

FIG. 1*b* is a view of a potential removing means for discarding consecutive labels from a sheet like support.

FIG. 2*a* is a view of a label ejection device with removing means and collecting means.

FIG. 2*b* is a view of collecting means.

FIG. 3*a* is a view of an example of removing means, such as a pad pushing on the collecting tape carrying a plurality of labels.

FIG. 3*b* is an alternative of the collecting means such as a label conveyor.

FIG. 4*a* is an embodiment of the label ejection device comprising collecting means such as rollers fixed to a supporting group and a removing means such as a pressing roller pushing the collecting tape in an advancing direction with the help of moving means such as pneumatic jack so as to remove a label detected.

FIG. 4*b* is an alternative of the label ejection device with a collecting means cooperating with removing means.

FIG. 5 is a view of the preferred embodiment of the faulty label ejection device.

FIG. 6 to 11: are successive views of the preferred embodiment of the label ejection device showing all the steps to remove a label from a sheet like support and to collect the said label in the dedicated collecting means.

FIG. 12 is a perspective view of the labeling printing reel to reel system comprising detection means, inkjet printer and a faulty label ejection device.

FIG. 13 is a perspective view of the labeling printing sheet to sheet system comprising detection means, inkjet printer and a faulty label ejection device.

Figures 1A, 1B:
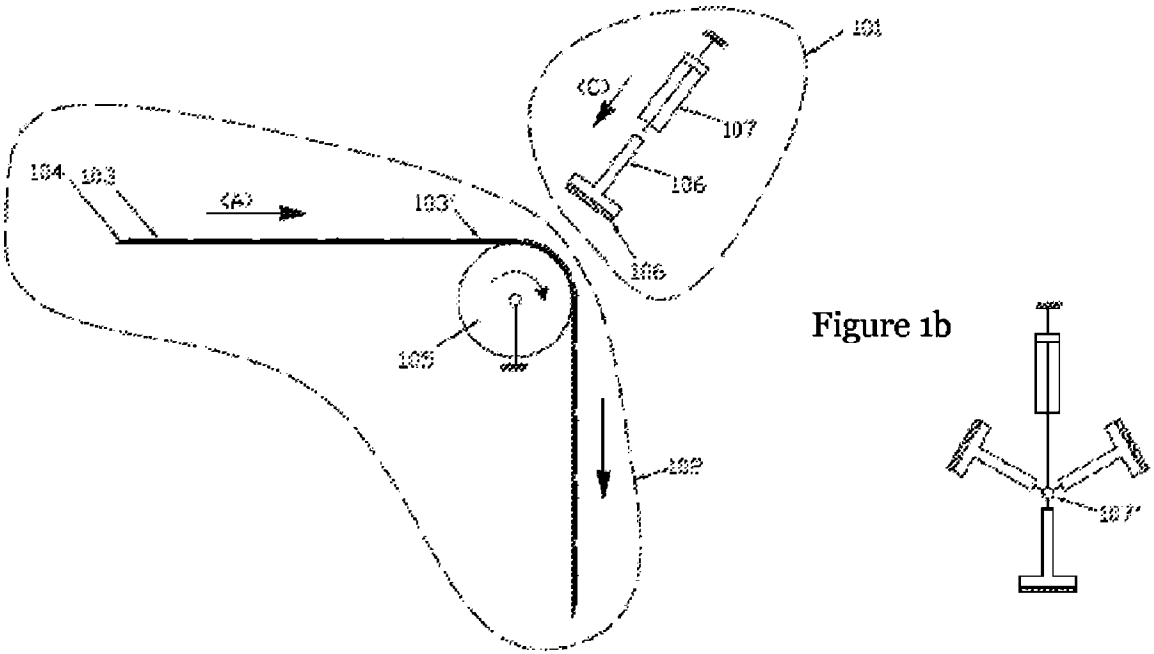

The drawings are shown for illustrative purposes only.

A label ejection device (101 FIG. 1A; 201 FIG. 2; 301 FIG. 3; 401 FIG. 4; 501 FIG. 5; 601 FIG. 6; 1201 FIG. 12; 1301 FIG. 13) for discarding labels to remove (103' FIG. 1A; 203' FIG. 2; 303' FIG. 3; 403' FIG. 4; 503' FIG. 5; 603' FIG. 6), applied on a sheet like support (104 FIG. 1A; 204 FIG. 2; 304 FIG. 3; 404 FIG. 4; 504 FIG. 5; 604 FIG. 6) comprising removing means (106 FIG. 1A; 206 FIG. 2; 306 FIG. 3; 406 FIG. 4; 506 FIG. 5; 606 FIG. 6), wherein said removing means has an adhesive portion (106' FIG. 1A; 206' FIG. 2; 310 FIG. 3; 410 FIG. 4; 510 FIG. 5; 610 FIG. 6) operable to enter into contact with a part of the surface of a faulty label on the sheet like support, adhere to said part of the surface, and said faulty label ejection device being operable to move apart said part of the surface adhering to removing means from the sheet like support, whereby the removing of said removed label from said sheet like support is carried out by a detachment of said part of the surface of said label to a complete separation due to the movement of the label ejection device.

Another embodiment of the label ejection device (101 FIG. 1A; 201 FIG. 2; 301 FIG. 3; 401 FIG. 4; 501 FIG. 5; 601 FIG. 6; 1201 FIG. 12; 1301 FIG. 13) is disclosed, wherein said labels are self-adhesive (103 FIG. 1A; 203 FIG. 2; 303 FIG. 3; 403 FIG. 4; 503 FIG. 5; 603 FIG. 6) and applied on a sheet like support (104 FIG. 1A; 204 FIG. 2; 304 FIG. 3; 404 FIG. 4; 504 FIG. 5; 604 FIG. 6) moving along an advancing direction (A).

Another embodiment of the label ejection device (101 FIG. 1A; 201 FIG. 2; 301 FIG. 3; 401 FIG. 4; 501 FIG. 5; 601 FIG. 6; 1201 FIG. 12; 1301 FIG. 13) is disclosed, wherein said device comprises collecting means (208 FIG. 2; 309+310+311 FIG. 3; 409+410+411 FIG. 4; 509+510+511 FIG. 5; 609+610+611 FIG. 6) arranged for receiving said removed labels.

Another embodiment of the label ejection device (101 FIG. 1A; 201 FIG. 2; 301 FIG. 3; 401 FIG. 4; 501 FIG. 5; 601 FIG. 6; 1201 FIG. 12; 1301 FIG. 13) is disclosed, wherein said collecting means comprise driving roller means (209+211 FIG. 2; 309+311 FIG. 3; 409+411 FIG. 4; 509+511 FIG. 5; 609+611 FIG. 6) arranged for moving a collecting tape (210 FIG. 2; 310 FIG. 3; 410 FIG. 4; 510 FIG. 5; 610 FIG. 6), being able to receive removed labels, with the help of an adhesive fixed on the external side of the said collecting tape.

Figure 3B:
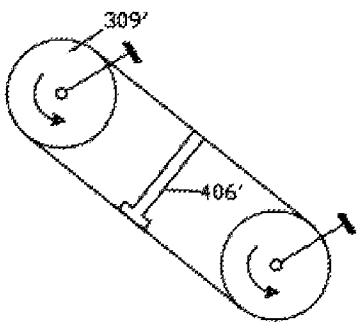
Figure 4B:
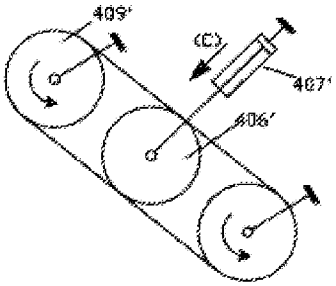
Figure 4A:
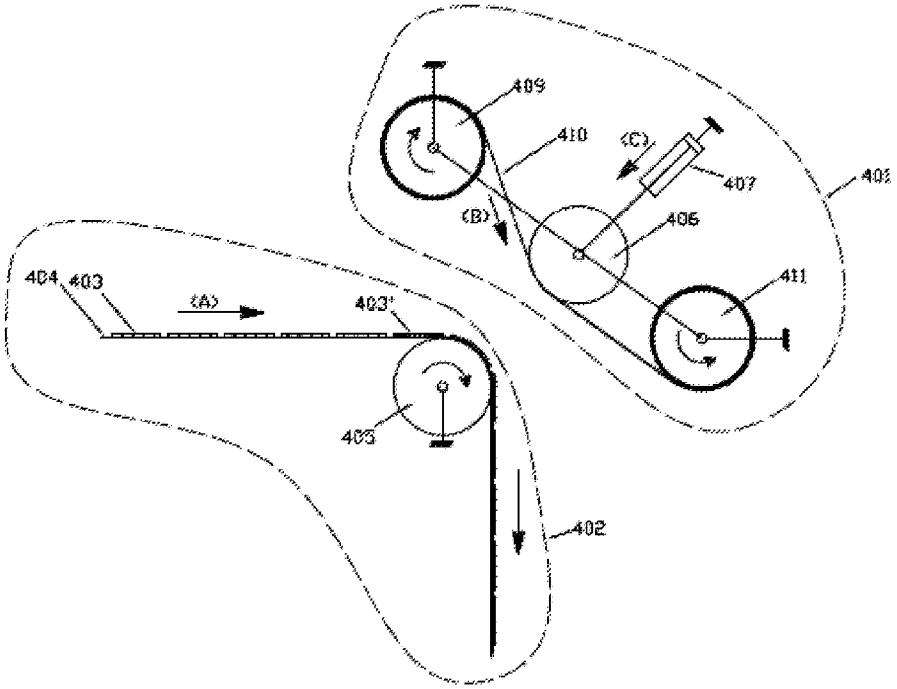
Figure 5:
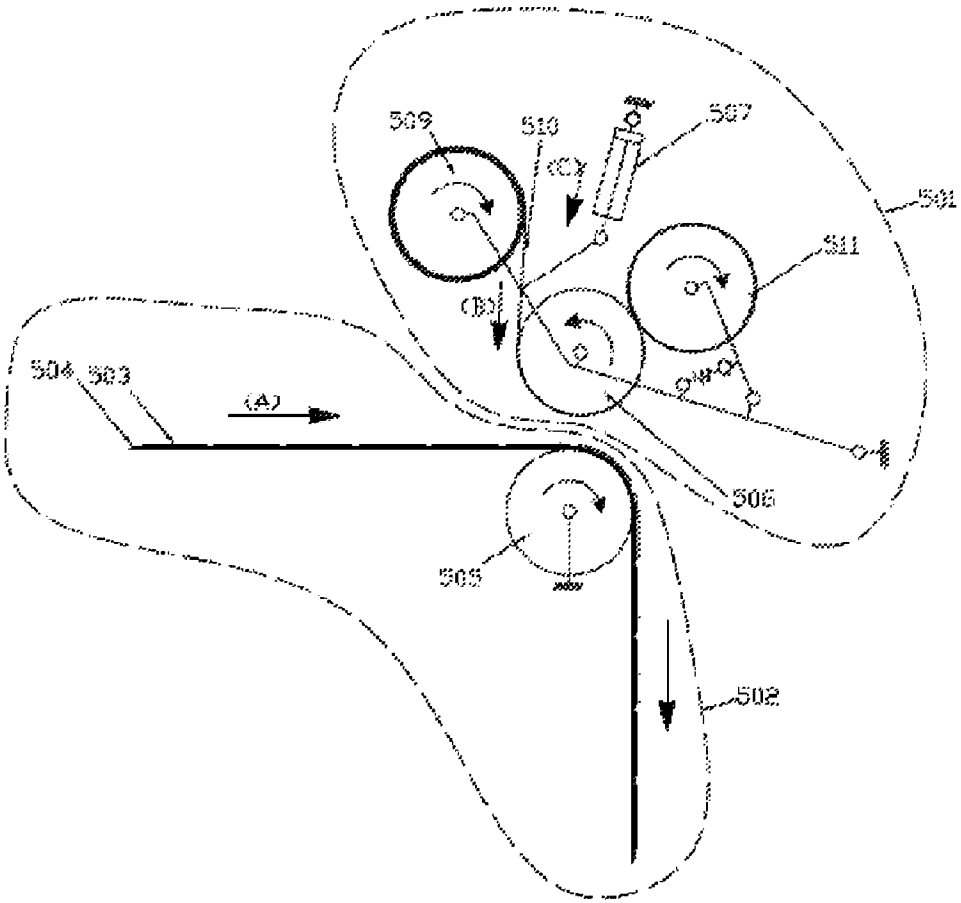
Figure 6:
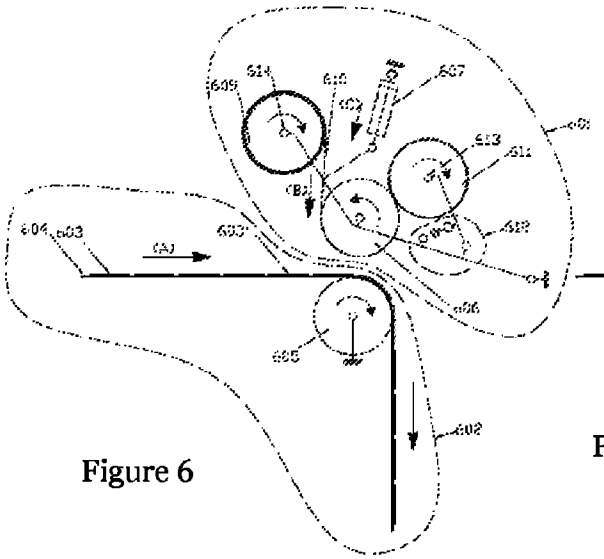

Another embodiment of the invention discloses a faulty label ejection device (101 FIG. 1A; 201 FIG. 2; 301 FIG. 3; 401 FIG. 4; 501 FIG. 5; 601 FIG. 6; 1201 FIG. 12; 1301 FIG. 13) comprises removing means pushing on the non-adhesive side of the collecting tape (210 FIG. 2; 310 FIG. 3; 410 FIG. 4; 510 FIG. 5; 610 FIG. 6) to catch said faulty label by adhesion from the sheet like support (104 FIG. 1A; 204 FIG. 2; 304 FIG. 3; 404 FIG. 4; 504 FIG. 5; 604 FIG. 6).

A faulty label ejection device (101 FIG. 1A; 201 FIG. 2; 301 FIG. 3; 401 FIG. 4; 501 FIG. 5; 601 FIG. 6; 1201 FIG. 12; 1301 FIG. 13) may comprise removing means which is at least a sticking pad (106 FIG. 1A, 107' FIG. 1B; 206 FIG. 2).

A faulty label ejection device (101 FIG. 1A; 201 FIG. 2; 301 FIG. 3; 401 FIG. 4; 501 FIG. 5; 601 FIG. 6; 1201 FIG. 12; 1301 FIG. 13) may comprise removing means such as a pressing roller (306 FIG. 3; 406 FIG. 4; 506 FIG. 5; 606 FIG. 6).

A faulty label ejection device (101 FIG. 1A; 201 FIG. 2; 301 FIG. 3; 401 FIG. 4; 501 FIG. 5; 601 FIG. 6; 1201 FIG. 12; 1301 FIG. 13) may comprise said pressing roller (306 FIG. 3; 406 FIG. 4; 506 FIG. 5; 606 FIG. 6) which rotates to remove the label.

Collecting means of the label ejection device (101 FIG. 1A; 201 FIG. 2; 301 FIG. 3; 401 FIG. 4; 501 FIG. 5; 601 FIG. 6; 1201 FIG. 12; 1301 FIG. 13) may comprise collecting tape (210 FIG. 2; 310 FIG. 3; 410 FIG. 4; 510 FIG. 5; 610 FIG. 6) such as a Scotch roll.

Removing means of the label ejection device (101 FIG. 1A; 201 FIG. 2; 301 FIG. 3; 401 FIG. 4; 501 FIG. 5; 601 FIG. 6; 1201 FIG. 12; 1301 FIG. 13) enter into contact with the removed label with the help of moving means (107 FIG. 1A; 207 FIG. 2; 307 FIG. 3; 407 FIG. 4; 507 FIG. 5; 607 FIG. 6).

Moving means of the label ejection device (101 FIG. 1A; 201 FIG. 2; 301 FIG. 3; 401 FIG. 4; 501 FIG. 5; 601 FIG. 6; 1201 FIG. 12; 1301 FIG. 13) may be a jack (107 FIG. 1A; 207 FIG. 2; 307 FIG. 3; 407 FIG. 4; 507 FIG. 5; 607 FIG. 6), such as a pneumatic or hydraulic jack.

The advancing speed of the collecting tape (210 FIG. 2; 310 FIG. 3; 410 FIG. 4; 510 FIG. 5; 610 FIG. 6) is the same than the sheet like support (104 FIG. 1A; 204 FIG. 2; 304 FIG. 3; 404 FIG. 4; 504 FIG. 5; 604 FIG. 6) with the help of the contacting means (512 FIG. 5; 612 FIG. 6).

As shown in FIG. 1*a*, a label ejection device (101) comprises removing means (106) which enter into contact to the label to remove (103') and remove directly the said label by adhesion from the sheet like support carrying the web of label (104). The removing means may be a sticking pad or similar containing at its border (106') facing toward the sheet like support (104) an adhesive surface being able to catch the printed side of the label to remove. The operating group in the present embodiment of the invention comprise moving means such as, for example, a pneumatic or hydraulic jack or the like (107) being able to move the removing means in an advancing direction (C) so as to catch the label to remove (103') by adhesion.

The movement to remove a label may be a movement from the labeling system (102) including the sheet like support (104) toward the label ejection device (101) or the opposite.

FIG. 1*a* illustrates that the preferred movement of the present invention for removing a label will be a movement from the removing means (106) of label ejection device (101) toward the sheet like support (104) with the help of moving means (107).

In order to remove successive labels, the removing means (106) may be constituted of a roller with at least one sticking pad fixed around it (see FIG. 1*b*). Sticking pad of different size may be used depending on the size of the label used. In this solution, the fixing means of the removing means should be adapted to obtain an easier and faster changing of the removing means of the label ejection device (101). Moreover, the removing means disclosed as shown in FIG. 1*b* may turn at any speed with the help of a motor dedicated or with a belt linked to the supporting roller (105).

Figure 2B:
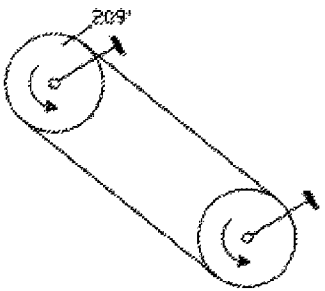
Figure 2A:
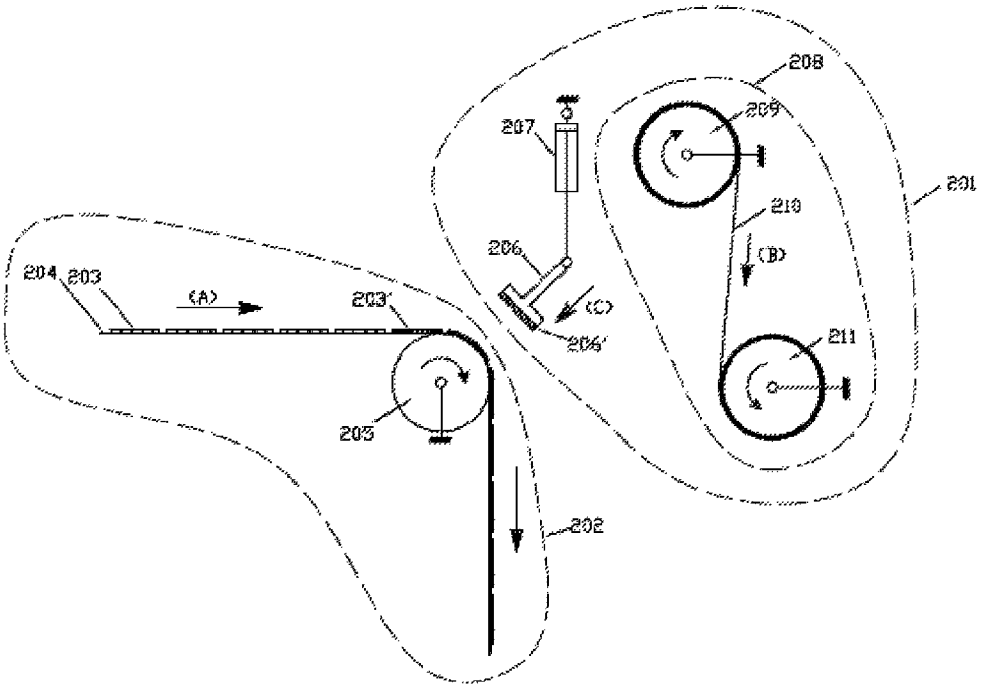

As further shown in FIG. 2*a*, the label may comprise also collecting means (208) arranged for receiving the labels to collect or to sort following the needs. Thus, the sticking pad(s) will transfer the removed label to the collecting means (208) in cooperation with the operating group to stick synchronously the faulty label on the collecting means at different place for any potential recovery. The collecting means (208) may comprise a collecting tape (210), which carries removed label received, unwound by driving rollers (209), (211) moving along an advancing direction (B). Said direction may be in both sides at any speed.

The collecting means (208) accumulates a plurality of removed labels increasing consequently its own diameter up to a limit value established by an operator. Once such limit value has been reached, the operator removes and substitutes the collecting means. Another configuration of the present invention of the collecting means as shown in FIG. 2*b* shows a collecting tape between driving rollers where the removed label are provided to a labeling applicator. The collecting tape turns around two or more driving rollers collecting removed labels and presenting said labels to the labeling applicator.

Figure 3A:
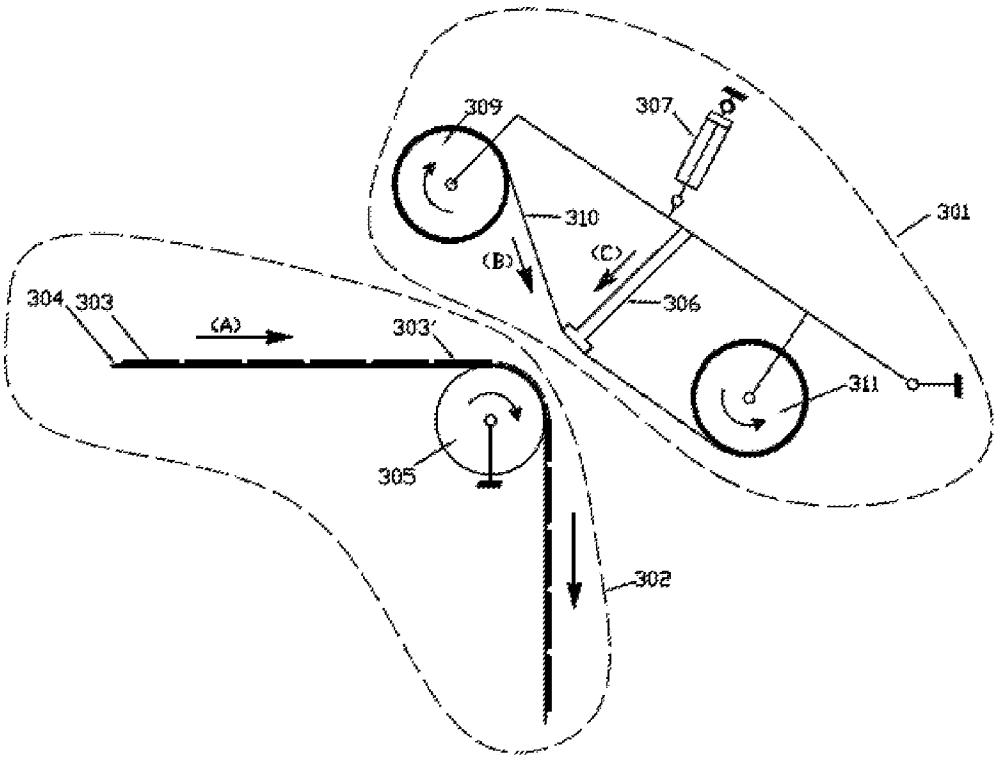

Another embodiment of the present object of the invention is disclosed in FIG. 3*a*. The label ejection device (301), for discarding labels (303') applied on the sheet like support (304) of labels (303) moving along an advancing direction (A), comprises removing means (306) and collecting means (309), (310), (311).

The said collecting means comprises driving rollers (309), (311) arranged for unwinding in an advancing direction (B) a collecting tape (310), being able to receive labels. The unwinding movement (B) of the collecting tape (310) may be in both sides. An adhesive is fixed on the side of the collecting tape (310) facing toward the sheet like support (304). Removing means (306), placed above the collecting tape (310), push on its non adhesive side in the advancing direction (C) to catch the label by adhesion from the sheet like support (304).

The removing means (306) may be a sticking pad, a bedplate, a peel plate, separating means or similar.

The sheet like support may carry self adhesive labels.

A control unit operable to, upon reception of the signal from detection means, control the label ejection device to discard the detected faulty label from the sheet like support, may launch the working of a driving element and moving means (307). Said driving element is used for the rotation of the collecting means such as driving rollers (309) (311). The rotation may be applied on one of them or both, in both directions.

Said moving means launches the movement of the removing means which enter into contact to the label detected and remove by adhesion said label at a determined position on the sheet like support (304).

The driving elements of the label ejection device (301) may be a motor for a periodic working of the collecting means or a belt for a continuous working of the collecting means.

As shown in FIG. 3*b*, another alternative of the collecting means is a label conveyor.

In a preferred embodiment of the invention, as shown in FIG. 4*a*, the removing means (406) is a pressing roller or a group of pressing rollers. A roller is more adapted for removing small and medium labels. The adhesion of the adhesive portion of the collecting tape on the surface of label detected under the pressure of the pressing roller so as to remove the said label is more uniform and without jolt on the sheet like support. A group of several pressing rollers takes better the form of the curve of the sheet like support (404). This configuration will be more adapted for big size of label allowing several points of contacts so as to catch smoothly and with more efficiency the faulty label.

The collecting tape (410) may be a Scotch roll or the like movable at the detection of a faulty label on the sheet like support (404).

The step of transfer of the faulty label from the removing means to the collecting means, as explained in the first aspect of the invention, is associated to the movement of the removing means due to the fact that the collecting tape with the help of the removing means has already caught the faulty label and is wound around a collecting roller containing a plurality of faulty labels.

The collecting means comprises a first roller un-winder (409), such as a Scotch roll, and a second roller winder (411) which collects the plurality of faulty labels after adhesion with the help of the removing means, both cooperating with the control unit operable to supervise the removing of a label.

From those skilled in the art, the working between the detection means and the control unit are well known so as to place the removing means face to the faulty label. The control unit allows to rotating the said first roller (411) of the collecting means at a predetermined time during a calculated period after the emission of the signal coming from the detection of the faulty label by detection means. The control unit controls operating group between the two rollers of the collecting means which may be a belt allowing a correct synchronization in rotation and a continual tension of the collecting tape (410).

The two driving rollers (409) and (411) are fixed to a support. The moving means such as a pneumatic or hydraulic jack or similar (407) lead to the movement in the advancing direction (C) of the removing means (406).

In a further embodiment, the operating group between a roller (405) of the sheet like support (404) and the first roller (411) of the collecting means may be a belt allowing a continuous rotation of the first and second rollers of the collecting means during the working of the labeling printing process.

In another embodiment of the invention, the rotation of the collecting means may be performed by a motor.

The sheet like support (404) is perfectly tightened allowing high speed so as to limit waste of time.

The advancing direction (A) of the sheet like support (404) may be the same than the advancing direction (B) of the collecting tape (410) or the opposite. In a preferred embodiment, the advancing direction (A) of the collecting tape (410) will be the same than the advancing direction (B) of the sheet like support (404).

The speed of advance of the articles or containers to be labeled and the speed of advance of the web are sensed continuously by electronic means, and the speed of advance of the supporting tape is adjusted as necessary to match the speed of advance of the articles to be labeled.

The width of the collecting tape (410) is adapted to the width of labels which is carried on the sheet like support (404).

As shown in FIG. 4*b*, another embodiment of the present invention is a collecting tape turning between two driving rollers (409', 411') such as a label conveyor belt. The removing means such as a pressing roller (406') may push on the non adhesive side of the collecting tape (410'). The removed label adheres to the collecting tape and this latter may be applied on the respective container by a label applicator system. In addition, a system adding an adhesive layer to the collecting tape may be included to the label ejection device. However, in case of a faulty label ejection, the number of label removed is limited and a collecting tape able to receive about ten fault labels is enough.

The preferred embodiment of the invention, as shown in FIG. 5, is illustrated in the FIGS. 6 to 11.

In FIG. 5, the label ejection device (501) is in a passive position. The labels (503) are carried by the sheet like support (504) at high speed. The sheet like support may be a supporting tape. A supporting roller (505) generates the advancing speed of said sheet like support (504). Said device (501) comprises removing means constituting of a pressing roller (506) with at its extremity a collecting tape (510) advancing in the direction (B), the same direction than the direction (A) of the supporting tape (504); and collecting means constituting of two driving rollers (509), (511) and operating group.

The pressing roller (506) is a standard Scotch roll adapted to the size of the label (503) that the device (501) may remove. Said driving roller (511) is a collecting roller comprising the plurality of faulty label (503'). A brake system is incorporated to the Scotch roll (509) so as to keep a resistance allowing a perfect tension of the collecting tape (510); a pneumatic or hydraulic jack (507) which moves the said device so as to allow the removing means constituted of the collecting tape (510) and the pressing roller (506) to enter into contact to the faulty label detected on the sheet like support (504); a system of pressure and a motor coupled to the collecting roller (511) leading to place a new virgin adhesive portion of the collecting tape (510).

The collecting roller (511) should stay in contact to the pressing roller (506) with the help of the system of pressure, such as adjustable spring, so as to rotate at the same speed to wind the plurality of the faulty label removed.

A motor is also coupled to accelerate the rotation of the collecting roller (511), the pressing roller in contact (506) to the collecting roller turns also so as to give new adhesive to the next faulty label which should be removed from the supporting means.

Figure 7:
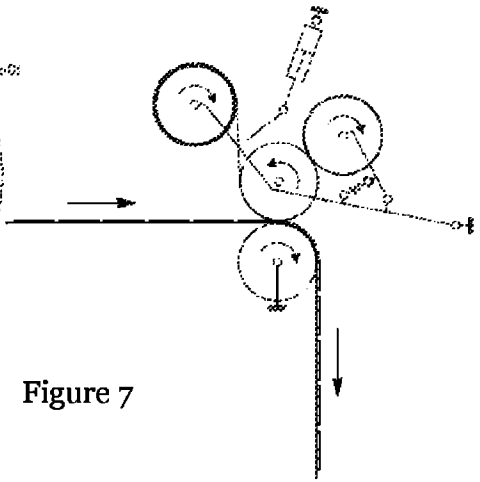

In FIG. 7, the jack (607) moves the faulty label device in contact to a faulty label (603') detected. Once detected, the device moves at the right place to catch the border of the label. The contact of the pressing roller (606), which is free of rotation, to the faulty label (603') advancing at the speed of the supporting tape (604), allows a rotation speed of the pressing roller (506) at the same speed than the supporting roller (605) of the supporting tape (604). The system of pressure coupled to the collecting roller (611) allowing a constant contact between the pressing roller (606) and the collecting roller (611) leads to the same rotation speed of the collecting roller (611) than the pressing roller (606) and the supporting roller (605).

Figure 8:
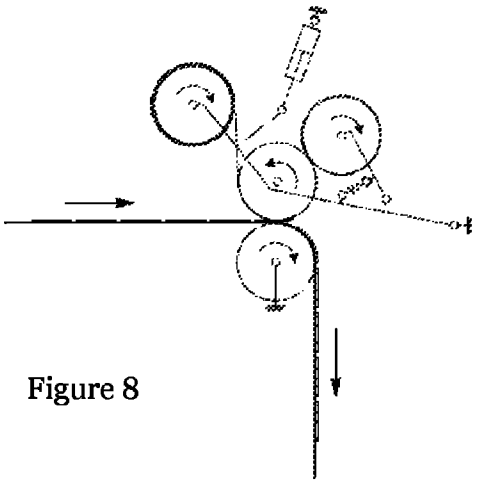

In FIG. 8, the border faulty label (603') is stuck on the further supporting tape (610).

Figure 9:
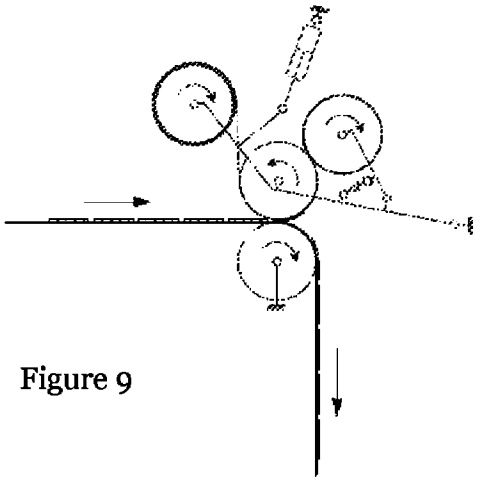

In FIG. 9, the faulty label caught adheres smoothly to the further supporting tape (610).

Figure 10:
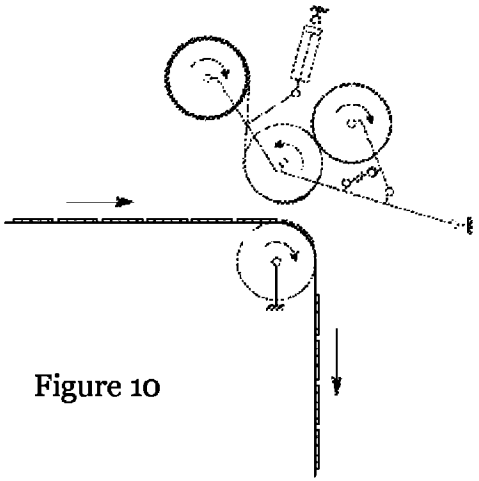

In FIG. 10, case of non successive faulty label to remove, the jack moves the device (601) in a passive position after removing of the faulty label.

Figure 11:
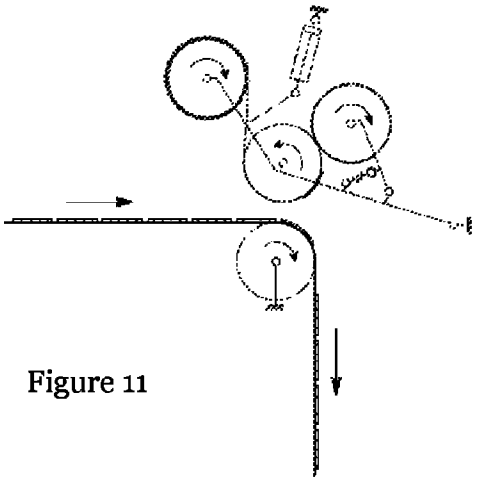

In FIG. 11, the motor coupled to the collecting roller (611) rotates so as to let a new virgin adhesive face toward a new faulty label to remove. This operation is needed to catch properly the border of the new faulty label and to receive completely the faulty label.

The position active and passive of the faulty label ejection device (601) may be different depending on the number of supporting roller (605) of the supporting tape (604).

The preferred embodiment of the labeling printing reel to reel system is disclosed as shown in FIG. 12. The labeling system for discarding faulty self adhesive labels applied on a supporting tape being operable to move along an advancing direction (A) and being bent on a supporting roller (1205), comprises a inkjet printer (1213) operable to print out a label on the sheet like support (1204); a faulty label ejection device (1201) which comprises detection means (1214) operable to detect a faulty printed label on the sheet like support, and transmit a signal indicating a detected faulty printed label; removing means for discarding a faulty printed label applied on the sheet like support having an adhesive portion operable to enter into contact with a part of the surface of the faulty printed label on the sheet like support, and adhere to said part; said label ejection device being operable to move apart said adhesive portion from the sheet like support up to the separation of the faulty printed label, thereby discarding said faulty printed label from said sheet like support; collecting means having an adhesive portion operable to receive said discarded faulty printed label, and comprising a driver operable to move a collecting tape supporting said adhesive portion, said collecting tape being operable to move between two driving rollers; and said removing means being operable to transfer the discarded faulty printed label to the collecting means by making a portion of said discarded faulty printed label to adhere to said adhesive portion of the collecting means, and comprising a portion of said collecting tape operable to enter into contact with said part of the surface of the faulty printed label on the sheet like support, and adhere to said part; said removing means including a pressing roller operable to bend the collecting tape at a level of the supporting roller, and driving means operable to push said pressing roller and make said portion of the collecting tape to adhere to said part of the surface of the faulty printed label on the supporting tape; and a control unit (1215) operable to, upon reception of the signal from said detection means, control the label ejection device to discard the detected faulty printed label from the sheet like support.

Optionally, we may add to the labeling printing system a coder coupled to a sensor or trigger (1216) to define the advancing speed and the position of labels applied on the supporting tape. An ejection detector (1217) may be also added after the supporting roller of the supporting tape to check the right ejection of the label which should have been removed.

Another system is disclosed in FIG. 13 on a labeling printing sheet to sheet system comprising the same devices as described in the FIG. 12. In the system disclosed, the sheet like support may be a sheet. The system is a labeling printing sheet to sheet system.

Those skilled in the art will appreciate that numerous modifications and variation may be made to the above disclosed embodiments without departing from the spirit and the scope of the invention.

The invention claimed is:

1. A label ejection device comprising:

a label remover structured for discarding labels applied on a supporting tape, the supporting tape being operable to move along an advancing direction and being bent on a supporting roller;

said label remover having an adhesive portion operable to enter into contact with a part of a surface of a label that is supported on the supporting tape, and adhere to said part;

a collector comprising:

a collecting tape having an adhesive portion operable to receive said label and being operable to move between two driving rollers, and a driver operable to move the collecting tape;

said label remover comprising the collector, such that the adhesive portion of the label remover comprises the adhesive portion of the collecting tape, so that, via the driver, the adhesive portion of said collecting tape contacts and adheres to said part of the surface of the label that is opposite a portion of the label contacting the supporting tape, whereby the label is discarded from the supporting tape by being transferred to the collector; and said label remover further comprising a pressing roller, operable to bend the collecting tape to a surface of the supporting roller, that is coupled to said driver so that said pressing roller is operable to push the adhesive portion of the collecting tape to adhere to said part of the surface of the label that is opposite a portion of the label contacting the supporting tape.

2. The label ejection device of claim 1, wherein said part of the surface of the label corresponds to a border of the label along said advancing direction.

3. The label ejection device according to claim 1, wherein said collecting tape is wound around at least one of the two driving rollers.

4. The label ejection device according to claim 1, further comprising:

a detector structured and arranged to detect a faulty label on the supporting tape, and transmit a signal indicating a detected faulty label; and a control unit operable to, upon reception of the signal from said detector, control the label ejection device to discard said faulty label from the supporting tape.

5. A labeling system for discarding faulty labels applied on and adhering to a supporting tape that is operable to move along an advancing direction and to be bent on a supporting roller, comprising:

a printer operable to print out a label on the supporting tape;

a faulty label ejection device comprising:

a detector structured and arranged to detect a faulty printed label on the supporting tape, and transmit a signal indicating a detected faulty printed label; and a label remover, structured and arranged for discarding a faulty printed label applied on the supporting tape, having an adhesive portion operable to enter into contact with a part of a surface of the faulty printed label that is supported on the supporting tape, and adhere to said part;

said faulty label ejection device being operable to move said adhesive portion away from the supporting tape in order to achieve separation of the faulty printed label, by which said faulty printed label is discarded from said supporting tape; and a control unit operable to, upon reception of the signal from said detector, control the faulty label ejection device to discard the detected faulty printed label from the supporting tape, a collector comprising: a collecting tape, operable to move between two driving rollers, supporting the adhesive portion of the label remover to receive said discarded faulty printed label; and a driver operable to move the collecting tape;

said label remover being operable to transfer the discarded faulty printed label to the collector tape by a portion of said discarded faulty printed label adhering to said adhesive portion supported by the collector tape as said adhesive portion supported by the collector tape enters into contact with said part of the surface of the faulty printed label that is opposite a portion of the label contacting the supporting tape, and adheres to said part;

said label remover including a pressing roller operable to bend the collecting tape at a level of the supporting roller, such that the driver is operable to push said pressing roller so that said adhesive portion supported by the collecting tape adheres to said part of the surface of the faulty printed label that is opposite a portion of the label contacting the supporting tape.

6. A method of operating the faulty label ejection device according to claim 1, comprising:

identifying faulty labels; and discarding the faulty labels using the collector and label remover of the faulty label ejection device.

* * * * *

UNITED STATES PATENT AND TRADEMARK OFFICE

CERTIFICATE OF CORRECTION

PATENT NO. : 8,986,498 B2
APPLICATION NO. : 13/504793
DATED : March 24, 2015
INVENTOR(S) : Christian Féfin It is certified that error appears in the above-identified patent and that said Letters Patent is hereby corrected as shown below:

ON THE TITLE PAGE

At Item (73) Assignee, of the printed patent, "SICPA Holding SA" should read --SICPA HOLDING SA--.

Signed and Sealed this
Twenty-fourth Day of November, 2015

Michelle K. Lee

Michelle K. Lee
*Director of the United States Patent and Trademark Office*